United States Patent [19]

Takahashi et al.

[11] Patent Number: 4,869,201

[45] Date of Patent: Sep. 26, 1989

[54] APPARATUS FOR COATING CAN BARRELS

[75] Inventors: Nobuo Takahashi; Yuri Takeda, both of Ohmiya; Akira Takamatsu, Iwatsuki; Yasushi Ito, Iwatsuki; Keizo Yamaguchi, Iwatsuki, all of Japan

[73] Assignee: Hokkai Can Co., Ltd., Tokyo, Japan

[21] Appl. No.: 58,290

[22] Filed: Jun. 4, 1987

[30] Foreign Application Priority Data

Jun. 4, 1986 [JP] Japan ..... 61-128145

[51] Int. Cl.[4] ..... B05B 7/24; B05C 5/02; B05C 19/00

[52] U.S. Cl. ..... 118/308; 118/317; 118/622; 427/236; 427/421; 427/424

[58] Field of Search ..... 118/305, 306, 317, 326, 118/308, 301, 622, D10, D11, 324, 624; 427/230, 233, 236, 421, 424; 198/626–628; 156/200, 310, 215, 218, 466

[56] References Cited

U.S. PATENT DOCUMENTS

| | | | |
|---|---|---|---|
| 3,687,705 | 8/1972 | Kilbane | 118/62 X |
| 4,239,570 | 12/1980 | Kerwin | 156/D27 |
| 4,615,296 | 10/1986 | Kolibas | 118/317 |
| 4,696,253 | 9/1987 | Frei | 118/622 |

*Primary Examiner*—Merrell C. Cashion, Jr.

*Attorney, Agent, or Firm*—Birch, Stewart, Kolasch & Birch

[57] ABSTRACT

Can barrels of uniform diameter produced from a can barrel forming device by forming a square-shaped blank into a tubular shape with opposite edges joined linearly, are conveyed successively coaxially in spaced relation at a first speed with the joined areas of the can barrels directed upwardly. Then the can barrels are conveyed at a second speed slower than the first speed such that the open edges of the can barrels are coaxially spaced closely with small gaps left therebetween. Paint is continuously applied to the inner and outer surfaces of the joined areas while the can barrels are being conveyed at the second speed with the open edges of the can barrels being closely spaced by the small gaps.

7 Claims, 3 Drawing Sheets

APPARATUS FOR COATING CAN BARRELS

BACKGROUND OF THE INVENTION

1. Field of the Invention

The present invention relates to a method of and and apparatus for coating paint to the inner and outer surfaces of joined areas of can barrels which are produced by a can barrel forming device.

2. Description of Background Art

Heretofore, the joined areas of a welded can for use as a can container are covered with protective paint coat layers in order to prevent the metal material of the can from being eluted into the canned substance and to prevent the joined areas from being eroded by the canned substance and to or by atmosphere with time. Such protective paint layers can be coated by applying liquid paint or powdery paint. The use of liquid paint is more advantageous since it can be more easily applied, it can produce a better coating appearance and it is more reliable in protecting the joined areas. The liquid paint is usually applied by flow coating or spray coating.

One known apparatus for applying liquid paint through spray nozzles to the inner and outer surfaces of joined areas of a can barrel produced by a can barrel forming device is illustrated in FIG. 4 of the accompanying drawings. The can barrel forming device, denoted at forms a square-shaped blank X' into a tubular form with its opposite edges joined by seam welding to provide a can barrel X of uniform diameter, which is then intermittently fed along an arm in the axial direction of the can barrel. The can barrel X is fed by a conveyor device c with the joined area Y held upwardly. A plurality of such can barrels X are successively fed by the conveyor device c in spaced-apart relationship. The opposite surfaces of the joined area Y of the can barrel X are coated with paint by a coating device f having a first spray nozzle which applies liquid paint, from below, to the inner surface of the joined area Y and a second spray nozzle which applies liquid paint, from above, to the upper surface of the joined area Y.

While the liquid paint is being continuously ejected toward the inner and outer surfaces of the joined area Y from the first and second spray nozzles d, e located inside and outside of the can barrel X which is fed at a relatively high speed, a mist of liquid paint is scattered through a gap h between adjacent can barrels X. This mist of liquid paint tends to contaminate the working environment and surrounding devices, and to smear portions of the can barrel other than the joined area. One solution would be to eject the liquid paint intermittently so that the liquid paint would be applied only to can barrels X and would not be ejected into gaps between adjacent can barrels X. It would additionally be desirable to apply a paint coating of uniform thickness to each of the opposite ends of the joined area Y of a can barrel X. However, such a coating process would require a sophisticated control system.

SUMMARY OF THE INVENTION

In view of the above drawbacks of the conventional can barrel coating apparatus, it is an object of the present invention to provide a method of and an apparatus for successively coating the joined areas of a plurality of can barrels without contaminating surrounding objects.

According to the present invention, there is provided a method of coating paint on the inner and outer surfaces of a joined area of a can barrel produced by forming a square-shaped blank into a tubular shape with opposite edges joined linearly, the method comprising the steps of conveying a plurality of can barrels of uniform diameter from a can barrel forming device successively coaxially in spaced relation at a first speed with the joined areas of the can barrels being directed upwardly, conveying the can barrels at a second speed which is slower than the first speed such that the open edges of the can barrels become coaxially closed spaced by small gaps left therebetween, and continuously applying paint to the inner and outer surfaces of the joined areas while the can barrels are being conveyed at the second speed with the open edges of the can barrels closely spaced by the small gaps.

In a further embodiment of the present invention, there is also provided an apparatus for coating paint on the inner and outer surfaces of a joined area of a can barrel produced by forming a square-shaped blank into a tubular shape with opposite edges joined linearly, said can barrel having two open edges, the apparatus comprising first conveyor means for conveying a plurality of can barrels of uniform diameter from a can barrel forming device, said plurality of can barrels being successively coaxially conveyed by said first conveyor means in spaced relation at a first speed while the joined areas of the can barrels are directed upwardly, second conveyor means disposed downstream of the first conveyor means for conveying the can barrels therefrom at a second speed, said second speed being slower than the first speed such that the open edges of the can barrels are coaxially closed spaced by small gaps left therebetween, and coating means for continuously applying paint to the inner and outer surfaces of the joined areas while the can barrels are being conveyed at the second speeds with the open edges of the can barrels being closely spaced by the small gaps.

These and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 1:
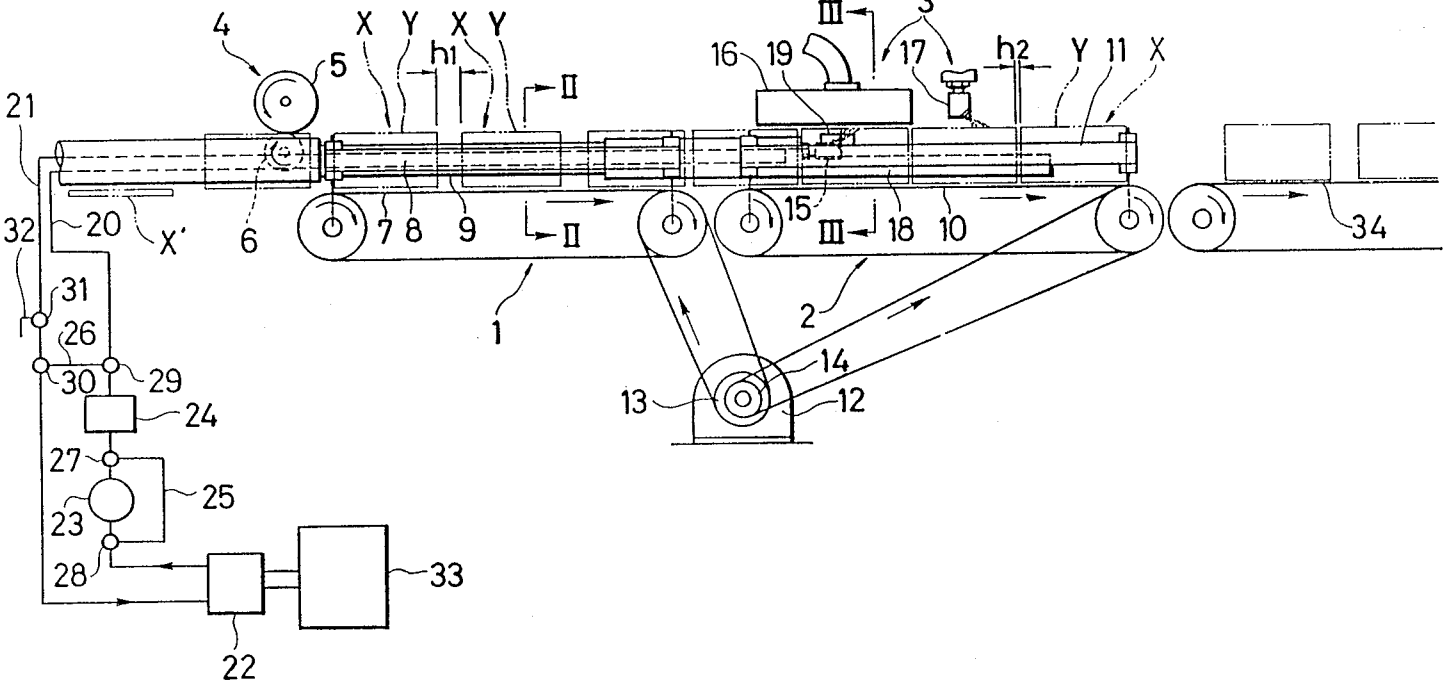
FIG. 1 is a schematic elevational view of a coating apparatus of the present invention.

Referring to the drawings and with particular reference to FIG. 1, an apparatus for coating the joined areas of can barrels according to the present invention is shown. The coating apparatus generally includes a first conveyor device 1, a second conveyor device 2, and a paint coating device 3.

A can barrel forming, device 4 produces a can barrel X by forming a square-shaped blank X' into a tubular shape of uniform diameter and welding the overlapping ends of the tube into a joined area Y with welding rollers 5, 6.

Figure 2:
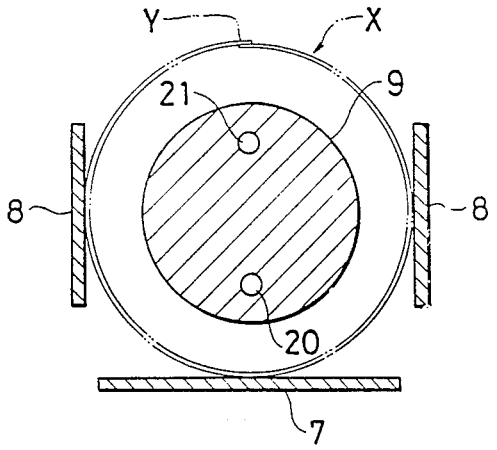
FIG. 2 is an enlarged cross-sectional view taken along line II—II of FIG. 1.

The first conveyor device 1 comprises a conveyor 7 for supporting the bottom of the can barrel X and a pair of laterally spaced conveyors 8 for gripping the opposite sides of the can barrel X, as shown in FIG. 2. These conveyors 7, 8 are operated in synchronism to feed the can barrel X. The first conveyor device 1 is disposed along a horizontal arm 9 along which the can barrel X formed and discharged by the can barrel forming device 4 is guided. The first conveyor device 1 has its starting end located at the discharge end of the can barrel forming device 4.

As shown in FIG. 2, the can barrel X has its joined areas Y directed upwardly while being supported by the conveyor 7 and gripped by the conveyors 8.

One can barrel X and a next can barrel X thus conveyed by the first conveyor device 1 are spaced from each other by a relatively large gap hl. The welding area Y of the can barrel X is cooled while the can barrel X is being fed along by the first conveyor device 1.

Figure 3:
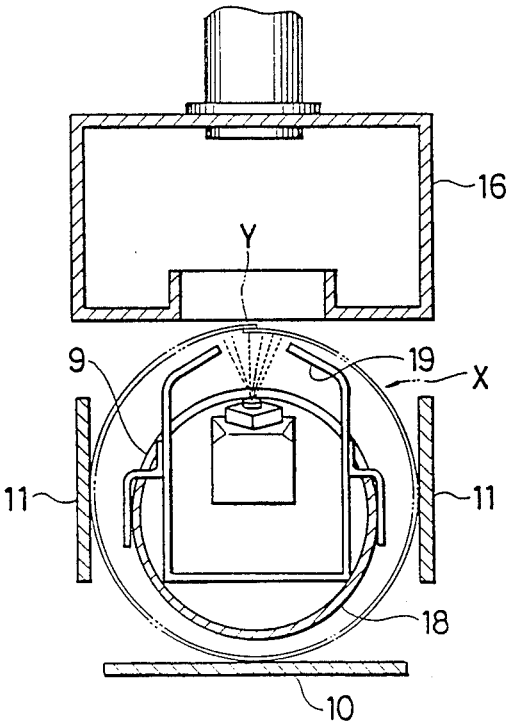
FIG. 3 is an enlarged cross-sectional view taken along line III—III of FIG. 1.
Figure 4:
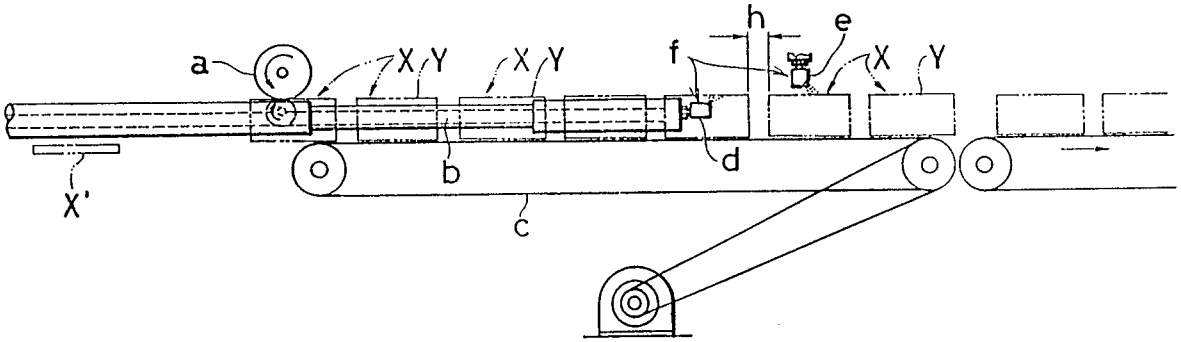
FIG. 4 BACKGROUND ART
FIG. 4 is a schematic elevational view of a conventional coating apparatus.

The second conveyor device 2 comprises, as shown in FIG. 3, a conveyor 10 for supporting the bottom of the can barrel X and a pair of laterally spaced conveyors 11 for gripping the opposite sides of the can barrel X. These conveyors 10, 11 are operated in synchronism to feed the can barrel X. The second conveyor device 2 has its starting end located at the terminal end of the first conveyor device 1, and extends along the arm 9.

As shown in FIG. 3, the can barrel X has its joined area Y directed upwardly while being supported by the conveyor 10 and gripped by the conveyors 11.

The first and second conveyor devices 1, 2 are driven by a common servomotor 12. More specifically, the first conveyor device 1 is operated by an endless belt trained around a driver pulley 13 coupled to the servomotor 12, whereas the second conveyor device 2 is operated by an endless belt trained around a driver pulley 14 coupled to the servomotor 12 and having a smaller radius than that of the driver pulley 13. Thus, the second conveyor device 2 feeds the can barrel X at a speed lower than the speed at which the first conveyor device 1 feeds the can barrel X, so that successive can barrels X fed from the first conveyor device 1 are spaced apart on the second conveyor device 2 by slight gaps h2 smaller than the gaps h1.

It is important that the can barrels X arrayed on the second conveyor device 2 be spaced by small gaps h2 while keeping their open edges out of contact.

It the opposite open edges of adjacent can barrels X were brought into contact with each other, then the can barrels X would rotate around the arm 9 to displace the joined areas Y out of the upper position, and the joined area Y thus displaced would not properly be coated subsequently.

Keeping the open edges of adjacent can barrels X slightly spaced by the gap h2 on the second conveyor device 2 depends on the speed at which the can barrels X are discharged from the can barrel forming device 4. Therefore, the servomotor 12 is operated in synchronism with the can barrel forming device 4.

The paint coating device 3 comprises a first coating nozzle 15, a paint mist remover 16 for removing paint mist which has leaked from between can barrels X, a second coating nozzle 17, and a paint receptacle 18 for receiving paint which has been ejected by the first and second coating nozzles 15, 17 and flowed downwardly as paint layers or small paint droplets.

The first coating nozzle 15 comprises an airless spraying gun mounted on the distal end of the arm 9 and having a nozzle outlet for ejecting paint obliquely upwardly toward the inner surface of the joined area Y of the can barrel X as it is fed along the arm 9.

The paint remover 16 is disposed above the can barrel X fed along the arm 9 and coupled to a suction device (not shown) through an air suction duct.

The second coating nozzle 17 comprises an airless spraying gun disposed upwardly of the can barrel X fed along the arm 9 and having a nozzle outlet for ejecting paint obliquely downwardly toward the outer surface of the joined area Y of the can barrel X as it is fed along the arm 9.

The paint receptacle 18 extends from the distal end of the arm 9 in the direction in which the can barrel X is fed, and is located below the first and second coating nozzles 15, 17 and within the can barrel X. The paint receptacle 18 has a paint width limiting member 19 for limiting the width of a range or zone coated by the first coating nozzle 15.

Operation of the coating apparatus of the present invention will now be described below.

A square blank X' is intermittently supplied to the can barrel forming device 4 and formed thereby into a can barrel X of uniform diameter with overlapping edges united by seam welding into a joined area Y. The can barrel X is then discharged toward the first conveyor device 1 on which it is fed along with the joined area Y directed upwardly. Successive can barrels X are conveyed by the first conveyor device 1 while being spaced by gaps hl. While the can barrels X are being successively fed along by the first conveyor device 1, the joined areas Y thereof which have been heated in the can barrel forming process are cooled. Then, the can barrels X are successively transferred from the first conveyor device 1 to the second conveyor device 2. The can barrels X are delivered on the second conveyor device 2 while being spaced by gaps h2 smaller than the gaps hl because the speed of travel on the second conveyor device 2 is lower than that on the first conveyor device 1. The can barrels X are delivered closely to each other in coaxial alignment with the gaps h2 being 1.0 mm or less. While the closely spaced can barrels X are moving on the second conveyor device 2 through the paint coating device 3, the inner surface of the joined area Y of each can barrel X is coated with liquid paint which is ejected obliquely upwardly from the first coating nozzle 15. Then, the outer surface of the joined area Y of the can barrel X is coated with liquid paint ejected obliquely downwardly from the second coating nozzle 17.

The can barrel X with the inner and outer surfaces of the joined area Y being thus coated is then delivered onto another conveyor device 34. The conveyor device 34 feeds successively coated can barrels X at a speed higher than the speed of travel on the second conveyor device 2, such that the successive can barrels X are spaced further apart than on the second conveyor device 2. The can barrels X are then successively fed by the conveyor device 34 into a drying oven (not shown).

Since the gaps between the can barrels X fed in closely spaced relation by the second conveyor device 2 are small, the amount of paint continuously ejected from the first and second coating nozzles 15, 17 and scattered through the gaps between the can barrels X is reduced, and so is the loss of paint, with the result that the working environment and surrounding devices are prevented from being contaminated by scattered paint. As the paint is continuously ejected from the first and second coating nozzles 15, 17, the joined areas Y of the can barrels X can be coated with a uniform layer of paint. The coating apparatus of the invention is particularly useful in reliably applying protective coatings to can barrels which are manufactured at high speed.

The paint receptacle 18 positioned below the first and second coating nozzles 15, 17 receives excessive paint ejected from these coating nozzles 15, 17 and also effectively prevents the second conveyor device 2 from being contaminated by the paint and also prevents the can barrels X from being smeared by any paint which would be applied from the contaminated second conveyor device 2.

The paint remover 16 positioned above the first coating nozzle 15 can effectively remove a small amount of paint which has leaked between adjacent can barrels that are coated. Therefore, the paint remover 16 is also effective in preventing the working environment and surrounding devices from being contaminated by leaking paint and also in preventing the can barrels X from being smeared by any paint which would be applied from the contaminated working environment and surrounding devices.

The direction in which the paint is applied by the first and second coating nozzles 15, 17 to the surfaces of the can barrel X is inclined at an angle preferably ranging from 10 to 30 degrees from the vertical direction toward the direction of travel of the can barrel X. This is advantageous in that even when the can barrel X is fed at high speed, the paint thus applied to the joined area Y of the can barrel X is repelled less and is not scattered away from the joined area Y. Accordingly, the coated paint layer is uniform in thickness and has a good appearance.

As illustrated in FIG. 1, the first coating nozzle 15 is connected to a paint circulating device 22 through a supply passage 20 and a return passage 21. The supply passage 20 is coupled to a paint pressure regulator 23 and a paint temperature regulator 24. A first bypass passage 25 is connected to the supply passage 20 across the paint pressure regulator 23, and a second bypass passage 26 is coupled between the supply and return passages 20, 21 downstream of the paint temperature regulator 24. The first bypass passage 25 has two three-way cocks 27, 28, the second bypass passage 26 has two three-way cocks 29, 30, and the return passage 21 is connected through a three-way cock 31 to a drain pipe 32. The paint is supplied from a paint tank 33. When starting a paint coating process, the first and second bypass passages 25, 26 are opened by the three-way cocks 27 through 30, and the paint circulating device 22 is operated. Since the paint fed under high pressure from the paint circulating device 22 does not flow through the paint pressure regulator 23, the pressure of the paint does not drop, and the paint can circulate at high pressure. The overall paint flow system can reach a prescribed temperature within a short period of time. Then, the second bypass passage 26 is closed to allow the paint to circulate through the supply passage 20, the return passage 21, and the first coating nozzle 15. Therefore, the paint flow system in the above paint circulation path can reach a prescribed temperature within a short period of time. Thereafter, the first bypass passage 25 is closed to cause the paint to flow through the paint pressure regulator 23 by which the paint pressure is set to a stable pressure level while the paint is kept at a prescribed temperature. Thus, the paint can be ejected from the first coating nozzle 15 operated by a pressure air actuator (not shown) in a stable pattern. The time required to start the paint coating process can be shortened. Since the initial coating of paint is stabilized, the quality of the coated product or can barrel is good.

For detaching the first coating nozzle 15 together with the arm 9 when the coating process is completed, the second bypass passage 26 is opened to allow the paint to flow only through the second bypass passage 26. The first coating nozzle 15 is then detached while the three-way cock 31 is open. When the arm 9 is to be connected again, the second bypass passage 26 is closed and the first bypass passage 25 is opened to supply the paint at high pressure to remove air from the supply and return passages 20, 21 through the drain pipe 32. Thereafter, the three-way cock 31 is closed and the first bypass passage 25 is closed. Since the temperature of the overall system is not lowered and trapped air can be removed within a short period of time, the inner surface of the joined area Y of the can barrel X can be coated well without undesirable coating defects.

Although a certain preferred embodiment has been shown and described, it should be understood that many changes and modifications may be made therein without departing from the scope of the appended claims.

What is claimed is:

1. An apparatus for coating paint on the inner and outer surfaces of a joined area of a can barrel produced by forming a square-shaped blank into a tubular shape with opposite edges joined linearly, said can barrel having two open edges, said apparatus comprising:

first conveyor means for conveying a plurality of can barrels of uniform diameter from a can barrel forming device, said plurality of can barrels being successively coaxially conveyed by said first conveyor means in spaced relation at a first speed while the joined areas of the can barrels are directed upwardly;

second conveyor means disposed downstream of said first conveyor means for conveying the can barrels therefrom at a second speed, said second speed being slower than said first speed such that the open edges of the can barrels are coaxially spaced with gaps left therebetween;

coating means for continuously applying paint to the inner and outer surfaces of said joined areas while the can barrels are being conveyed at said second speed with the open edges of the can barrels being spaced by the gaps; and a paint receptacle disposed below said coating means and within can barrels being coated by said coating means, said paint receptacle receiving excess paint ejected by said coating means for preventing contamination of the second conveyor means and smearing of the can barrels by excess paint.

2. The apparatus according to claim 1, further including an arm arranged in the same axial direction as said can barrels, said first conveyor means being arranged to convey the can barrels along said arm and said second conveyor means being arranged to convey the can barrels along said arm after said can barrels have been conveyed by said first conveyor means.

3. The apparatus according to claim 1, wherein each of said first and second conveyor means comprises at least three conveyors for holding said can barrels at lower and side portions thereof to convey the can barrels axially thereof.

4. The apparatus according to claim 1, wherein said coating means comprises a first coating nozzle for applying paint obliquely upwardly to the inner surfaces of the joined areas of the can barrel, a paint remover disposed above said first coating nozzle for removing paint ejected from said first coating nozzle for removing paint ejected from said first coating nozzle, and a second coating nozzle disposed above said first coating nozzle for applying paint obliquely downwardly to the outer surfaces of the joined areas of the can barrels, said paint receptacle being disposed below said first and second coating nozzles for receiving the excess paint ejected from the first and second coating nozzles.

5. The apparatus according to claim 4, wherein said paint receptacle has a paint width limiting member, said paint width limiting member and paint receptacle enclosing said first coating nozzle, said paint width limiting member having an opening therein for permitting paint to pass from said first coating nozzle to the can barrels, said opening having a width for limiting an amount of paint reaching said can barrels whereby excess paint from said first coating nozzle will remain in an area defined by said paint receptacle and said paint width limiting member.

6. The apparatus according to claim 4, wherein said paint remover is disposed over said paint receptacle, said paint remover and paint receptacle being separated by said can barrels.

7. The apparatus according to claim 1, wherein said paint receptacle has a paint width limiting member, said paint width limiting member and paint receptacle enclosing at least a portion of said coating means, said paint width limiting member having an opening therein for permitting paint to pass from said coating means to the can barrels, said opening having a width for limiting an amount of paint reaching said can barrels whereby excess paint will remain in an area defined by said paint receptacle and said paint width limiting member.

* * * * *